US005183333A

United States Patent [19]

Minowa

[11] Patent Number: 5,183,333

[45] Date of Patent: Feb. 2, 1993

[54] PRINTER SYSTEM FOR SELECTIVE PRINTING ON FIRST AND SECOND PRINT MEDIA LOCATED IN SEPARATE PRINT ZONES

[75] Inventor: Masahiro Minowa, Suwa, Japan

[73] Assignee: Seiko Epson Corporation, Tokyo, Japan

[21] Appl. No.: 683,468

[22] Filed: Apr. 10, 1991

[30] Foreign Application Priority Data

Apr. 11, 1990 [JP] Japan ..... 2-96023
Apr. 24, 1990 [JP] Japan ..... 2-108041
May 7, 1990 [JP] Japan ..... 2-117178

[51] Int. Cl.[5] ..... B41J 11/52

[52] U.S. Cl. ..... 400/605; 400/120; 400/323; 400/607.1

[58] Field of Search ..... 400/120, 320, 323, 322, 400/605, 607, 607.1, 608.2, 584, 585, 607.2, 607.3, 608.3, 223, 225, 235; 101/288; 156/384, 387

[56] References Cited

U.S. PATENT DOCUMENTS 4,229,113 10/1980 Anderson et al. ..... 400/608.4
4,375,923 3/1983 Hidaka et al. ..... 400/82
4,564,411 1/1986 Holzer ..... 400/609
4,826,336 5/1989 Kamimura et al. ..... 400/607.3
4,927,728 5/1990 Kuzuya ..... 400/208
5,028,934 7/1991 Kasai et al. ..... 346/76 PH

FOREIGN PATENT DOCUMENTS 0327075 8/1989 European Pat. Off. .
3128360 2/1983 Fed. Rep. of Germany .
1008346 1/1950 France .
215367 12/1983 Japan .
208957 9/1986 Japan ..... 400/120
107577 5/1988 Japan ..... 400/120

*Primary Examiner*—Edgar S. Burr
*Assistant Examiner*—Joseph R. Keating
*Attorney, Agent, or Firm*—W. Douglas Carothers, Jr.

[57] ABSTRACT

A printing system, according to the present invention, is comprised of a carriage having a thermal print head and associated ink ribbon cartridge, a platen, a label tape cassette, and a suitable housing and control electronics. The thermal print head can be alternatively positioned over the platen for printing on ordinary paper, or positioned to be in contact with the label tape cassette for making adhesive labels. An optical sensor detects when the printing carriage swings beyond the normal plain paper printing range. The thermal print head has sufficient dot forming capability and the control electronics is designed to support the printing of many fonts, including Japanese Kanji (Chinese characters), Hiragana, Katakana, and Romaji (e.g., English alphabet).

17 Claims, 10 Drawing Sheets

PRINTER SYSTEM FOR SELECTIVE PRINTING ON FIRST AND SECOND PRINT MEDIA LOCATED IN SEPARATE PRINT ZONES

BACKGROUND OF THE INVENTION

This invention relates generally to electronic printers and specifically to those that are able to print ink on plain paper and adhesive tape label mediums.

Typewriters and computer printers able to print ink on plain paper using a cartridge ink ribbon and thermal print head are well known in the prior art. Less well known are devices that can put letters and numbers on adhesive backing. In the United States, an early example of such a device was the Dymo Label Maker. A handheld device with a wheel to select the desired letter or number, one character at a time, is rotated to a proper position and a trigger is squeezed on a piston grip. The character was then embossed on a plastic tape in a manner similar to embossed characters on credit cards. The plastic tape is then fed out one character space at a time and is ultimately cut from a roll of such tape. An adhesive backing protective paper is peeled off and the tape can then be stuck onto things to label them. Such tapes have been popular in retail stores to label bins with the prices of items in those bins. Another kind of tape labelling system is produced by Kroy Manufacturing of Kroy, NY. The Kroy machine is a table-top unit with a large wheel to select numbers and letters. As each character is put into position a button is pressed to print the character on a tape. The tapes can be similar to transparent SCOTCH tape, and again have an adhesive backing.

Until the present invention, the above two kinds of printers where available only in separate units. Typewriters and computer printers could not be used to produce adhesive label tapes and vice versa. Since word printers and lettering tape devices are individually expensive, it is often difficult for the average user to own both. As a result, sales have fallen short of the need.

An object of the present invention is to provide a printing system that is able to print on single sheets of ordinary paper and lettering tape within a single affordable unit.

SUMMARY OF THE INVENTION

According to the present invention, a printing system is comprised of a carriage having a thermal print head and associated ink ribbon cartridge, a platen, a label tape cassette, and a suitable housing and control electronics. The thermal print head can be alternatively positioned over the platen for printing on ordinary paper, or positioned to be in contact with the label tape cassette for making adhesive labels. An optical sensor detects when the printing carriage swings beyond the normal plain paper printing range. The thermal print head has sufficient dot forming capability and the control electronics is designed to support the printing of many fonts, including Japanese Kanji (Chinese characters), Hiragana, Katakana, and Romaji (e.g., English alphabet).

An advantage of the present invention is that a printing system is provided for both plain paper printing and label tape making that is less expensive than the separate units it replaces.

A further advantage of the present invention is that the plain paper printing and label tape making sides share a common keyboard input and/or computer interface.

A further advantage of the present invention is that label tapes can be produced in association with related paper documents and that can help in making for a more natural work flow.

An advantage of the present invention is that it is possible to have a combination of two types of functions in a single printing device. Ordinary paper printing and lettering tape preparation can be combined, making the combination unit very useful and opening up a wide range of applications.

A further advantage of the present invention is that the thermal head control and font data are common. Large cost reductions are possible, compared to prior art. It will therefore be possible to expand the scope of applications and use in word processors.

A further advantage of the present invention is that the ink ribbon cassette and the label tape cassette are separate units. A user can mix and match label tape colors and ink colors freely. As such, this enables the use of inexpensive, commercially available ink ribbon cartridges.

A further advantage of the present invention is that the label tape cassette has its printing window and the tape exit on opposite sides of the cassette. This minimizes the tape transport length inside the printing cassette, and thus has the advantage efficient parts layout.

Other objects and attainments together with a fuller understanding of the invention will become apparent and appreciated by referring to the following description and claims when taken in conjunction with the accompanying drawings.

DESCRIPTION OF THE PREFERRED EMBODIMENTS

Figure 1A:
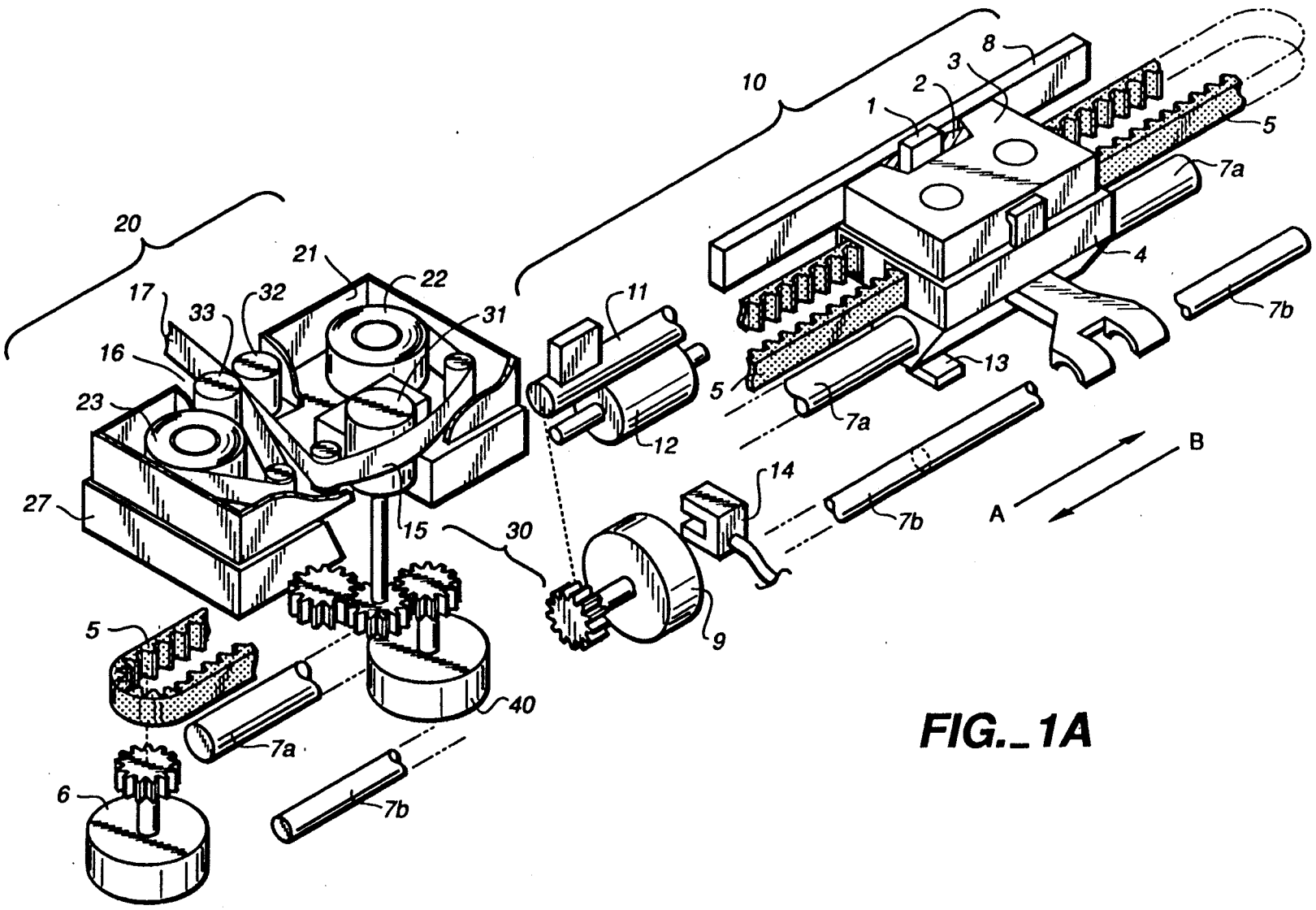
FIG. 1A is a exploded parts assembly diagram of the thermal print head and associated ink ribbon cartridge, platen, label tape cassette, and associated belts and drive motors for a printer according to the present invention.
Figure 1B:
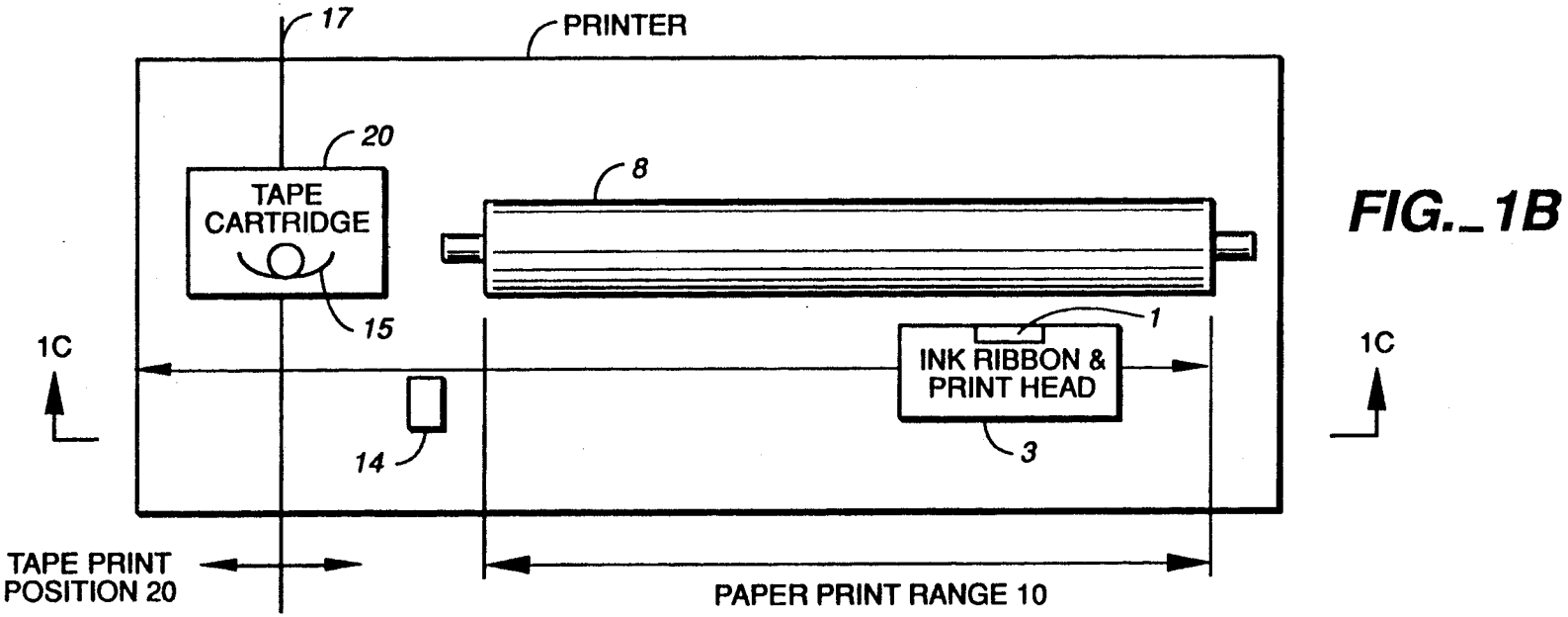
FIG. 1B is a top view showing the relationship of the thermal print head and associated ink ribbon cartridge, platen, and label tape cassette.
Figure 1C:
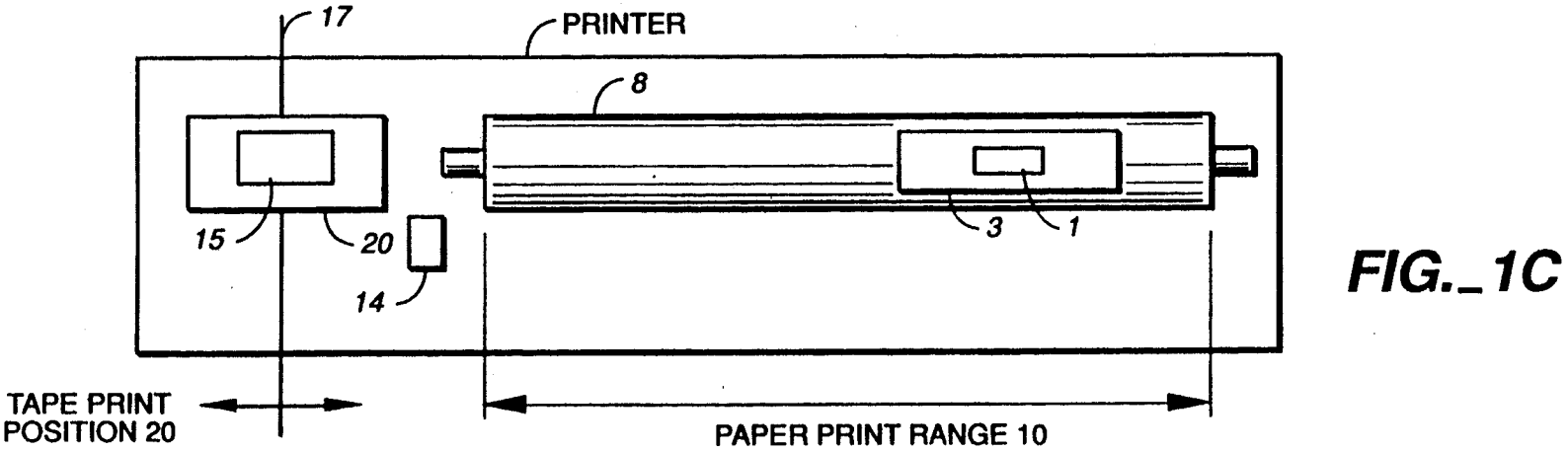
FIG. 1C is a side view of the same elements of FIG. 1B showing the printing surfaces of the label tape cassette and plain paper platen.

FIGS. 1(*a*)–1(*c*) show a printing system that is comprised of a carriage assembly 4 having a thermal print head 1 and associated ink ribbon cartridge 3, a platen 8, and a label tape cassette 21, all of which are preferably enclosed by a suitable housing and connected to appropriate control electronics. The thermal print head 1 can either be positioned over the platen 8, for printing on ordinary paper, or positioned to be in contact with the label tape cassette 21 through printing window 15, for making adhesive labels. An optical sensor 14 detects when the printing carriage 4 swings beyond the normal plain paper printing range 10. The thermal print head 1 has sufficient dot forming capability and the control electronics is designed to support the printing of many fonts, including Japanese Kanji (Chinese characters), Hiragana, Katakana, and Romaji (e.g., English alphabet). Thermal print head 1 has several heating elements (illustrated as 1*a* in FIG. 4) that are arranged in a tight row. Ink ribbon cartridge 3 comprises ink ribbon 2 and an ink ribbon supply and take-up spools. Carriage 4 is mounted such that it can slide left and right (in directions A and B) on guide shafts 7*a* and 7*b*. Belt 5 engages with carriage motor 6 and drives carriage 4.

Usually ink ribbons are wound by gears that turn when a carriage moves. But the carriage here does not always move during printing, so that a separate means is employed to wind ink ribbon cartridge 3. A ribbon winding motor 69 (shown in FIGS. 4, 10(*a*)–10(*b*), and 11) is used here that is independent of carriage motor 6. The paper that will be printed on is fed in by the combination of paper feed roller 11 and supplemental roller 12. A paper feed motor 9 drives paper feed roller 11 and supplemental roller 12 through a system of gears. A tab 13 on carriage 4 is positioned with photosensor 14 to give a positive indication when the left extreme paper printing position is reached. Tab 13 will pass through a light beam that bridges a gap in photosensor 14.

The structure described thus far is similar to conventional serial printers. What is not to be found in the conventional printer is a provision for a tape print region 20 that can be used to prepare lettering (label) tape and that is accessible to the thermal print head 1. Located within tape printing area 20 is a label tape cassette 21 that contains a transparent label tape 22 and an adhesive tape 23 (the upper cover of cassette 21 has been removed to reveal the internal details). The two types of tape are kept on separate rolls and joined only after the printing has been accomplished. After printing and the two tapes are joined together, the ink indicia on the tape is sandwiched between the tapes and is, therefore, very durable. Adhesive tape 23 is sticky on both sides. Transparent tape 22 has no adhesive and is able to receive printed ink indicia when pinched between tape platen 31 and thermal print head 1. A printing window 15 in label tape cassette 21 provides access to thermal print head 1. Printed tape is dispensed out through tape exit 16. Printing window 15 and tape exit 16 are at opposite sides of the cassette to keep the tape transit length short and to optimize the arrangement of parts within cassette 21. Cassette fixture 27 receives and positions the label tape cassette 21. A tape drive gear assembly 30 is located underneath fixture 27. Platen roller 31, compression roller 32 and compression supplemental roller 33 are all driven in unison by tape drive gear assembly 30.

Figure 2:
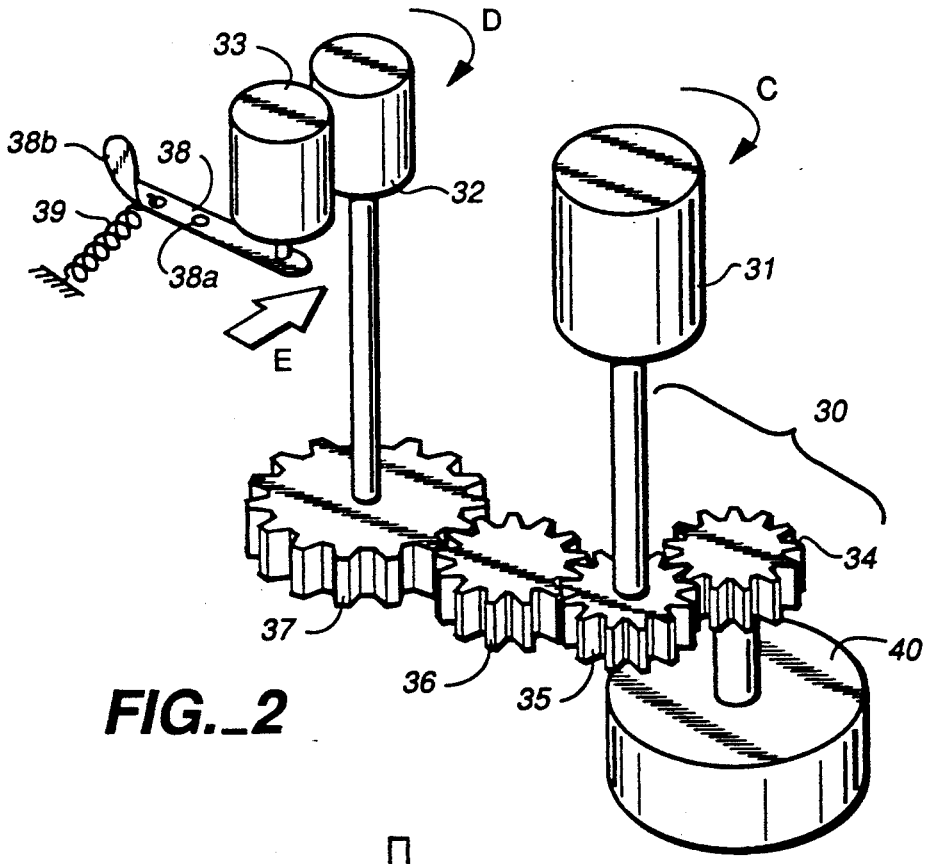
FIG. 2 is a perspective detail of the label tape cassette drive gear, motor, and roller assembly for the printer of FIGS. 1A–1C.

FIG. 2 details the relationships between gears 34, 35, 36 and 37, drive platen roller 31, compression roller 32, and tape transport motor 40. A tape pressure adhesion mechanism comprises compression roller 32, opposing roller 33, coil spring 39 and tape drive gear assembly 30. Platen roller 31 rotates clockwise in direction "C". Label tape is held under pressure against platen roller 31 by thermal head 1, and is pulled through cassette 21 by compression roller 32 and opposing roller 33. Tension on opposing roller 33 is controlled by a lever 38. Roller 33 is pulled in direction "E" against roller 32 by coil spring 39. Compression roller 32 turns clockwise in direction "D". Label tape and adhesive tape join together between rollers 32 and 33 to make lettering tape 17. A release at the large end 38*b* of lever 38 helps in the easy removal of cassette 21.

Figure 3:
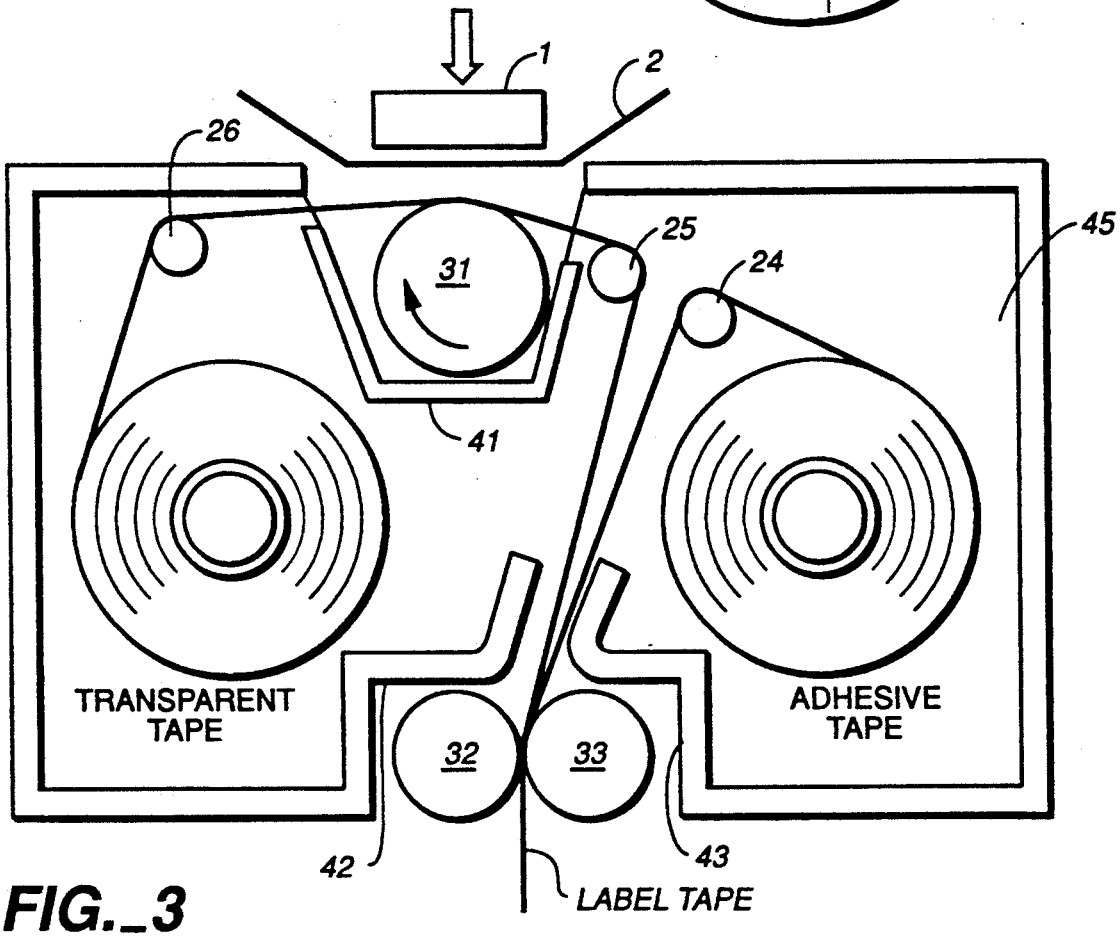
FIG. 3 is a cross-sectional view of the label tape cassette for the printer of FIGS. 1A–1C with the thermal print head and ink ribbon shown in a position ready for printing of the label tape.

FIG. 3 illustrates a label tape cassette that has rollers 24, 25 and 26 for guiding and stabilizing the movement of tape. A lower frame has segments 41, 42 and 43 to aid in protecting the cassette interior from foreign objects. An upper frame (not shown) covers and encloses the cassette unit.

Figure 4:
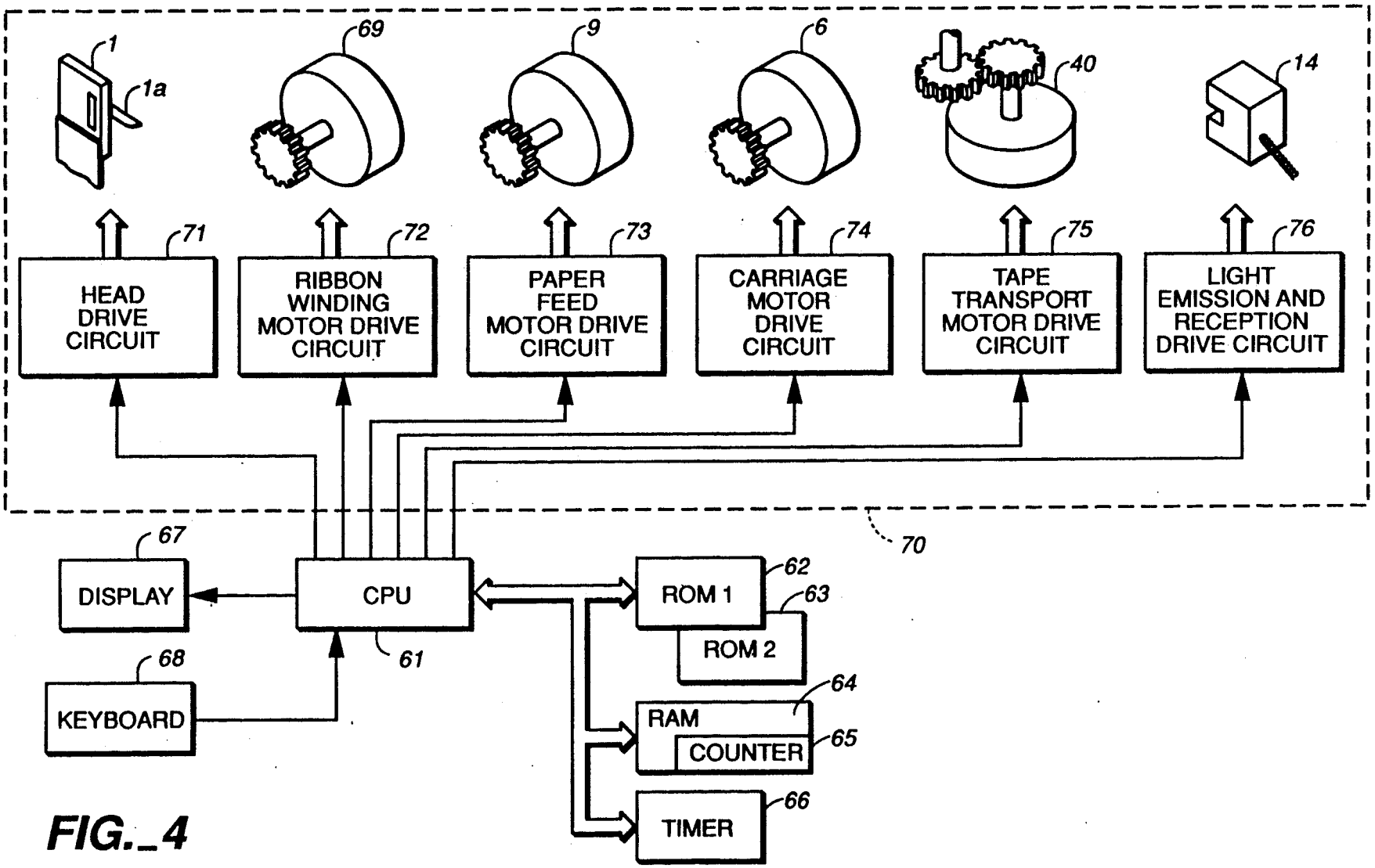
FIG. 4 is a system block diagram of the electronics control system used to support the printing function.

FIG. 4 shows how the four motors 6, 9, 40, and 69, the thermal print head 1, and the photosensor 14 can be connected to a microcomputer system to do wordprocessing. The motors are preferably stepper motors so that their speeds and angular positions can be readily control by the microcomputer system. Microcomputer CPU 61 has a ROM 62 (containing a control program), a ROM 63 (containing character fonts), a RAM 64 (for temporary data storage), and a timer 66. A register 65 within RAM 64 is used as a counter. The choice between using the paper print region 10 or the tape print region 20 is made by the user using keyboard 68. When the tape print region is selected, carriage motor 6 moves carriage 4 in direction "B" a prescribed number of steps beyond the reference position of photosensor 14. The counter area 65 inside RAM 64 is is preferably used to register the count. When ordinary paper printing is selected, the carriage is moved back within region 10. The operation within the paper printing region 10 is conventional, and so is not further explained here. When the carriage has been moved to the label tape printing position, the thermal head is loaded or pressed against platen roller 31. (See, U.S. Pat. No. 4,775,869, for background on how this loading may be implemented.) A ribbon winding mechanism (not illustrated) simultaneously drives ink ribbon 2 and drives label tape drive gear assembly. Data sent to the thermal head 1 is synchronized with the tape and ribbon movement, such that characters and symbols are formed on label tape 22. Immediately after printing, the two parts of label tape 17 are pressed together by compression roller 32 and opposing roller 33. A tape cutter is preferably positioned near tape exit 16.

Figure 5:
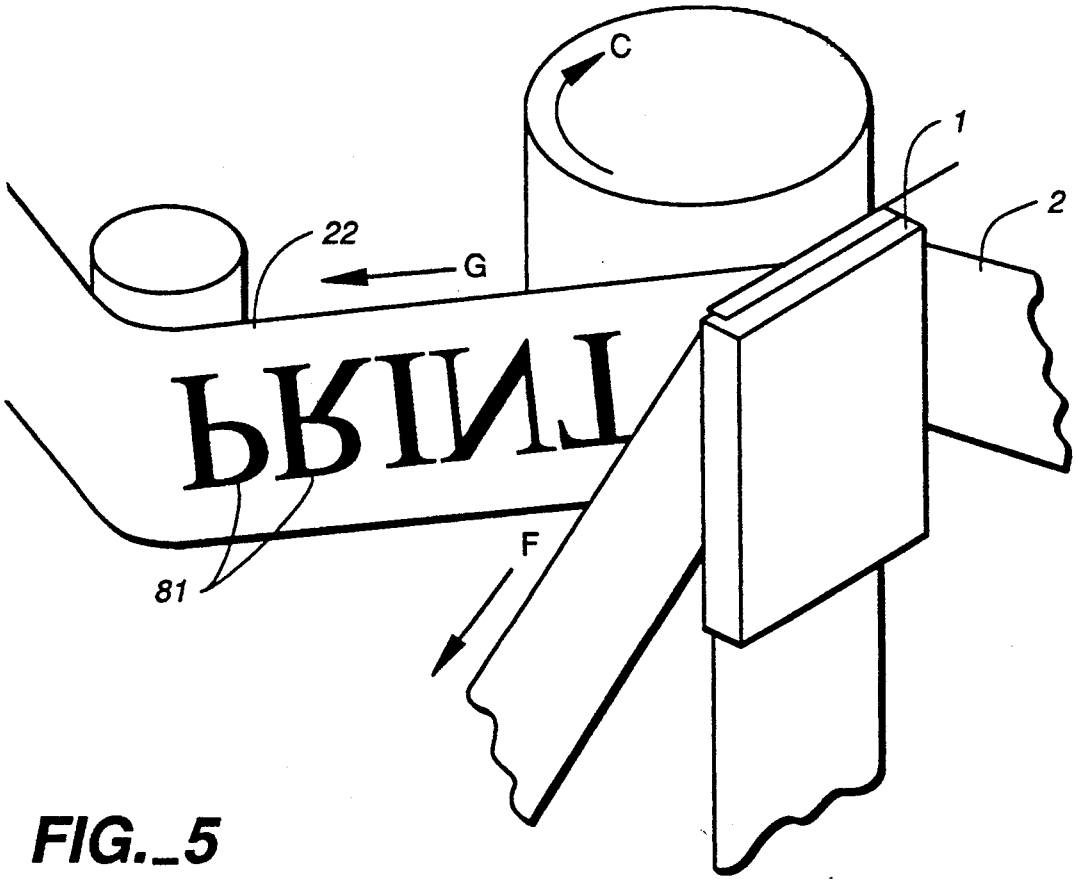
FIG. 5 gives an enlarged view of the thermal print head and ink ribbon and shows how an ink image is printed in mirror-image format on transparent tape so that the word "PRINT" will properly read from the other side of the transparent tape after it has been joined with an adhesive backing.

FIG. 5 shows how an image, in ink, is printed in mirror-image format on transparent tape as the tape moves past thermal print head 1 in direction "G". The word "PRINT" is formed of characters 81 and will be properly oriented as viewed from the other side of the transparent tape after the transparent tape has been joined with an adhesive backing (e.g., tape 23). The ink ribbon moves off to the take-up reel in direction "F" at a constant speed. Both the label tape and ink ribbon move at identical speeds, in order to prevent ink smudging under the thermal head 1. As described above, separate motors control each and are matched in speed. A spring mechanism on the take-up side of the ink ribbon winding mechanism keeps the ink ribbon taught. As mentioned, characters 81 are printed as a mirror-image, and therefore are quite different from the printed characters used in the ordinary paper print region 10. However, the font data for the characters and symbols used in the ordinary paper print region can be employed in a conventional manner.

Figure 6:
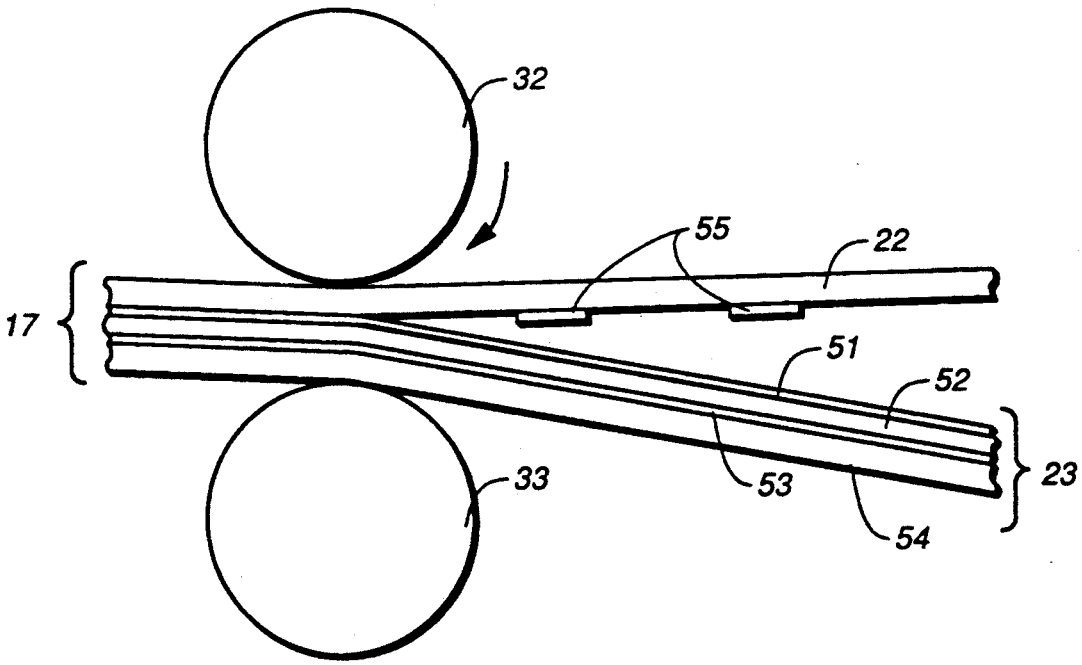
FIG. 6 shows how, after printing, the transparent label tape is joined together with the adhesive backing which includes a peel-off layer for later use in the application of the finished label to a surface.
Figure 7:
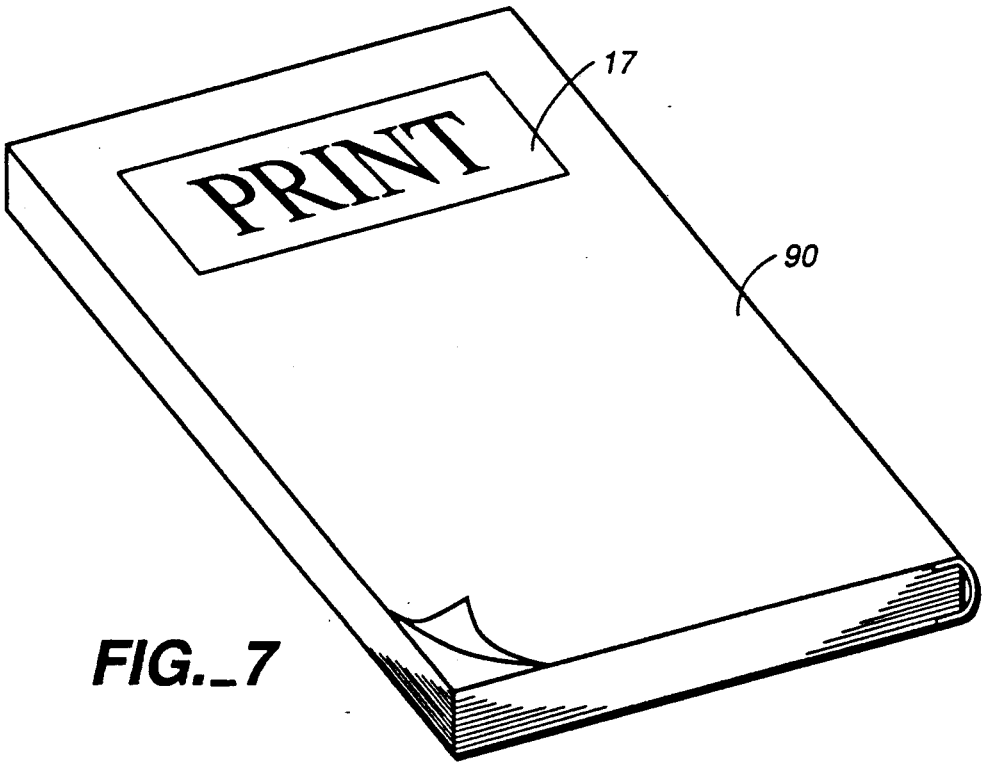
FIG. 7 shows the finished label of FIG. 5 after its having been applied to the cover of a book.

FIG. 6 shows, in cross-section, transparent tape 22, after printing, being joined with adhesive tape 23. The ink deposits 55 are on the inside surface of tape 22. Tape 23 comprises adhesive layers 51 and 53, base film 52, and peel-off backing 54. Tapes 22 and 23 are squeezed together by compression roller 32 and opposing roller 32 and output composite label tape 17. The peel-off backing is easily removed and the tape 17 will adhere to almost any surface. Since the printed ink deposits 55 are inside composite label tape 17, the resulting label will be exceptionally durable and long-lasting. FIG. 7 shows a finished label 17 applied to book 90.

Figure 8:
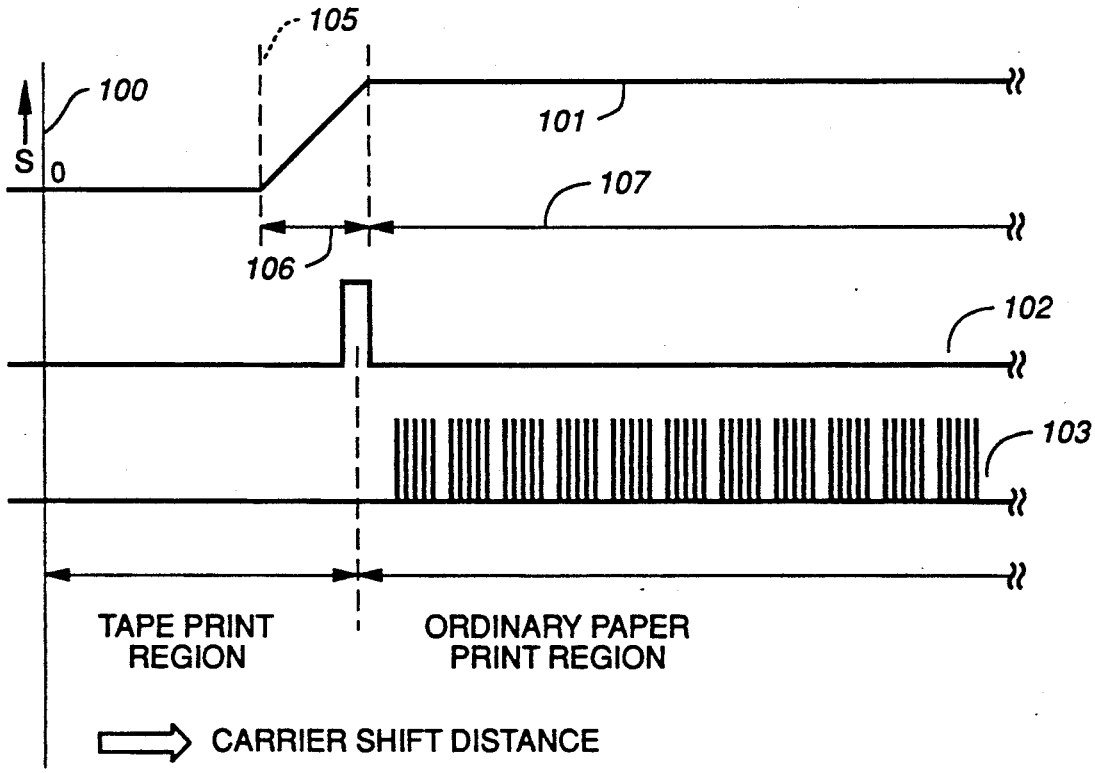
FIG. 8 is a graphic illustration of the carriage motor speed to carriage position within one of three speed zones: the fastest zone is where the carriage is in position for paper printing; the slowest zone is in the tape printing are: and the third zone is a velocity ramp-up area in between the first two.

FIG. 8 is a chart having the position of carriage 4 for a horizontal axis. Line 100 represents the position of the carriage for tape printing. Line 101 relates the carriage motor position to lateral carriage speed (S). Starting from a position 105 after receiving a print command, carriage 4 accelerates through region 106, where photosensor 14 detects the position of carriage 14. A shift to constant velocity is made in the paper printing region 107. Line 102 shows the detection waveform produced by photosensor 14. Line 103 is an exemplary stepper motor drive waveform. The acceleration region 106 is within the tape print region to minimize any carriage shift distance and keep the overall width of the printer mechanism to a minimum. Carriage 4 returns to position 105 to wait for the next paper print command. When such a command arrives, the carriage is accelerated from a stop and reaches a constant speed at a known starting point indicated by photosensor 14. The carriage waiting position (used during ordinary paper printing) and the label tape print position can be one and the same position.

Figure 9:
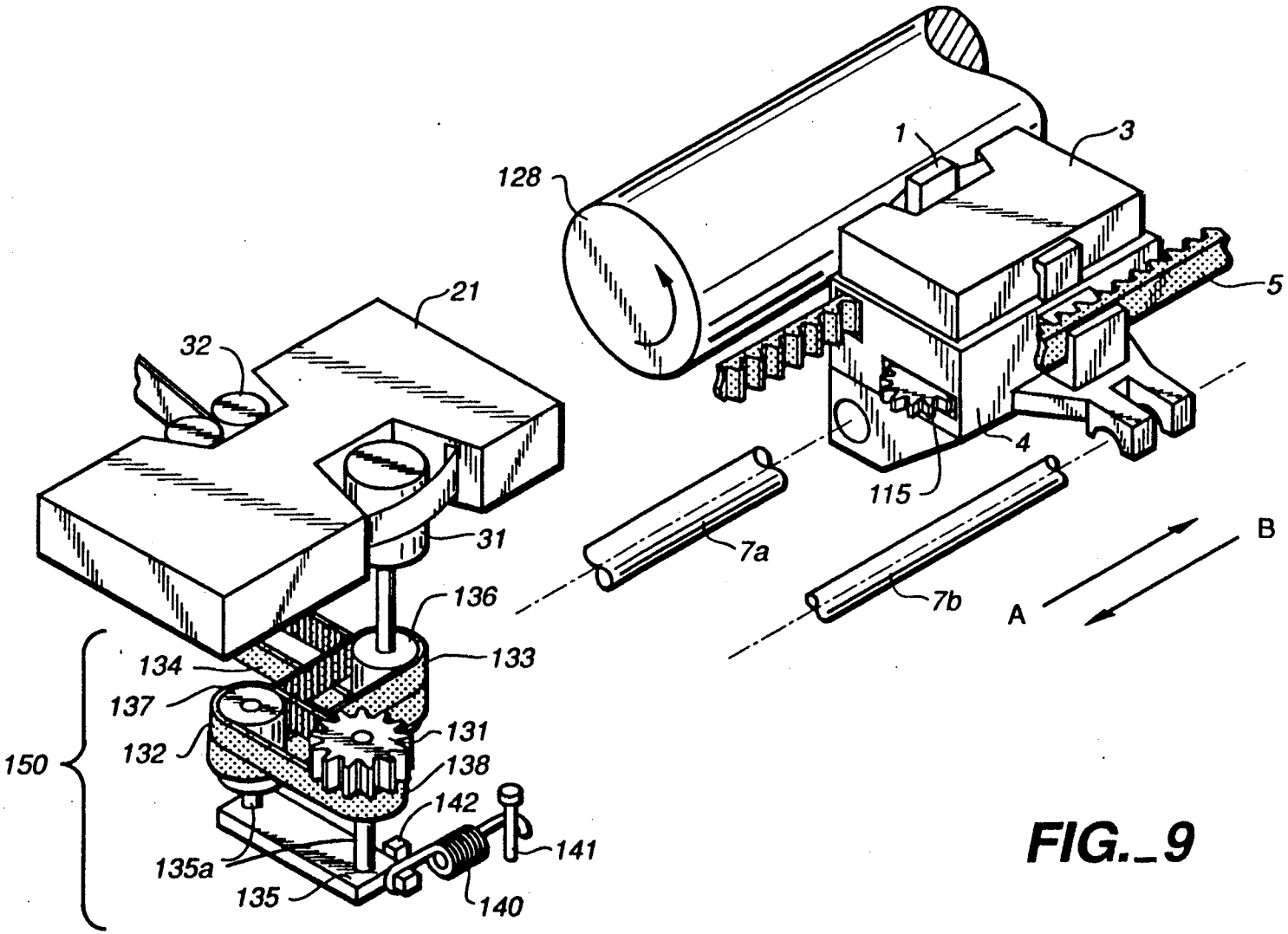
FIG. 9 is another embodiment of the present invention.

FIG. 9 illustrates a second embodiment of the present invention wherein a drive gear 115, driven by a ribbon winding motor (e.g., motor 69 inside carriage 4), is exposed through the side of carriage 4. When carriage 4 is moved left to the tape printing position, thermal head 1 will be opposite to label tape platen roller 31 and gear 115 will engage with gear 131. A round platen 128 is opposite to printing head 1 when carriage 4 is in the paper printing position. Belts 132–134 and pulley hubs 136–138 turn platen roller 31 and compression roller 32 (e.g., FIG. 1A). Support 135 allows pulley hub 137 and drive gear 131 and pulley 138 to rotate via belt 132 as a unit on shafts 135*a*. A coil spring 140 is extended between support 135 and pin 141 mounted on the printer frame to maintain the assembly against stopper 142. This arrangement allows some latitude in the position of carriage 4 and further guarantees positive teeth meshing of gears 131 and 115.

Figure 10A:
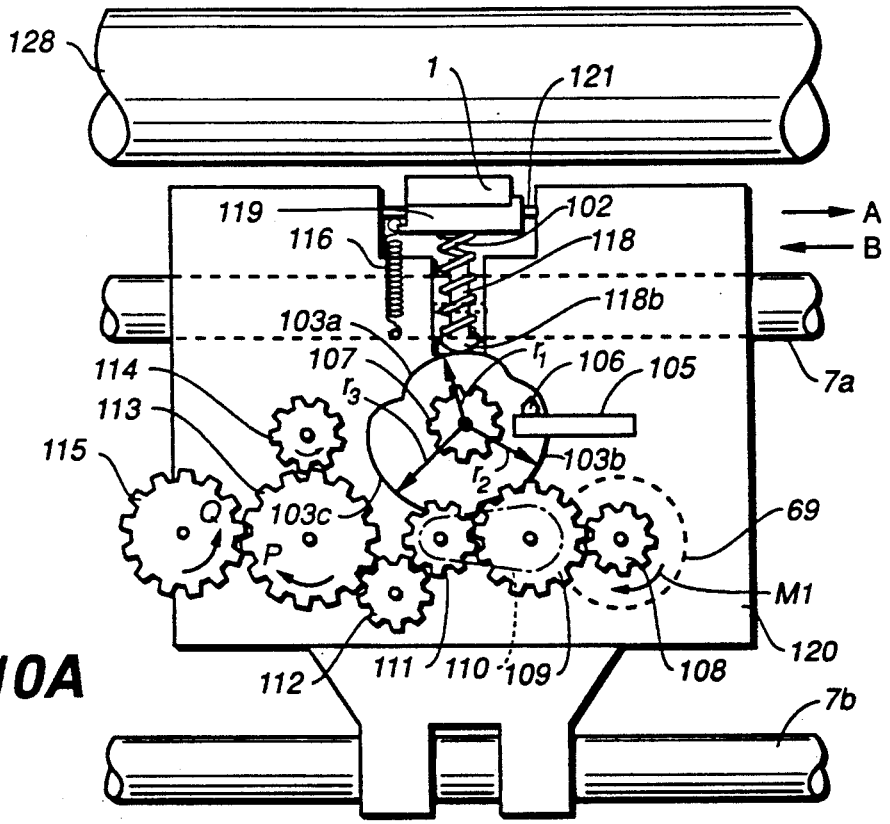
FIGS. 10A and 10B illustrate how a system of gears in the carriage assembly is used in the embodiment of FIG. 9 to drive the label tape cassette, ink ribbon cartridge, and to load the thermal print head on the print medium at either a high or low pressure, depending on the print medium.
Figure 10B:
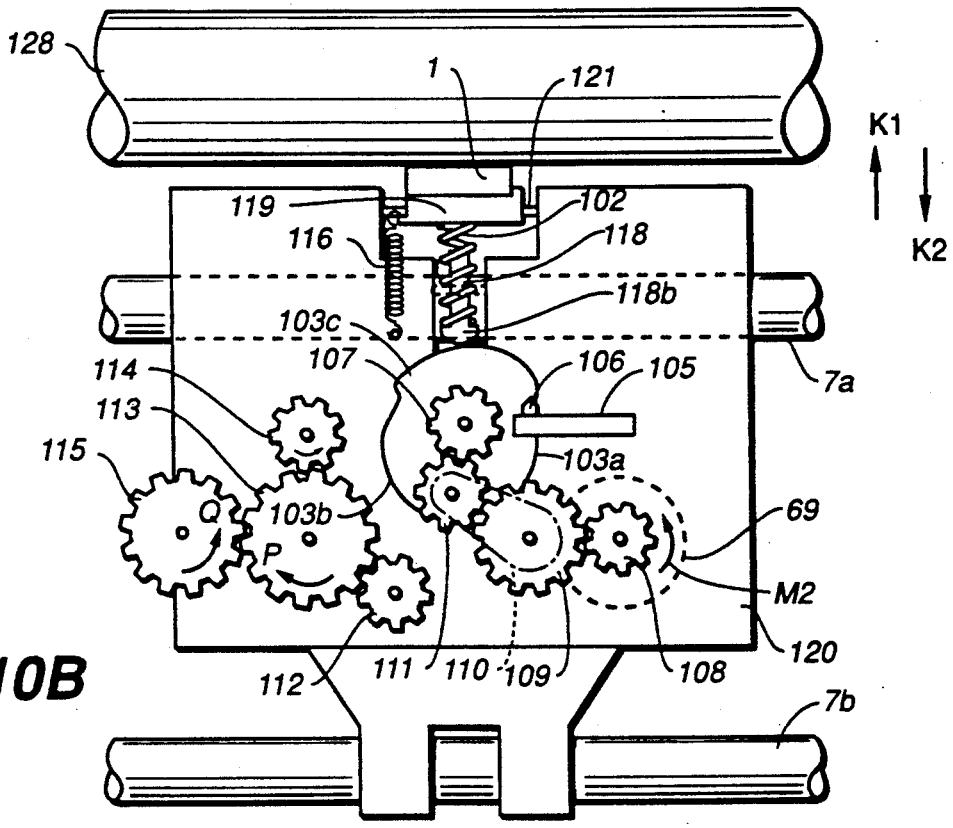
Figure 11:
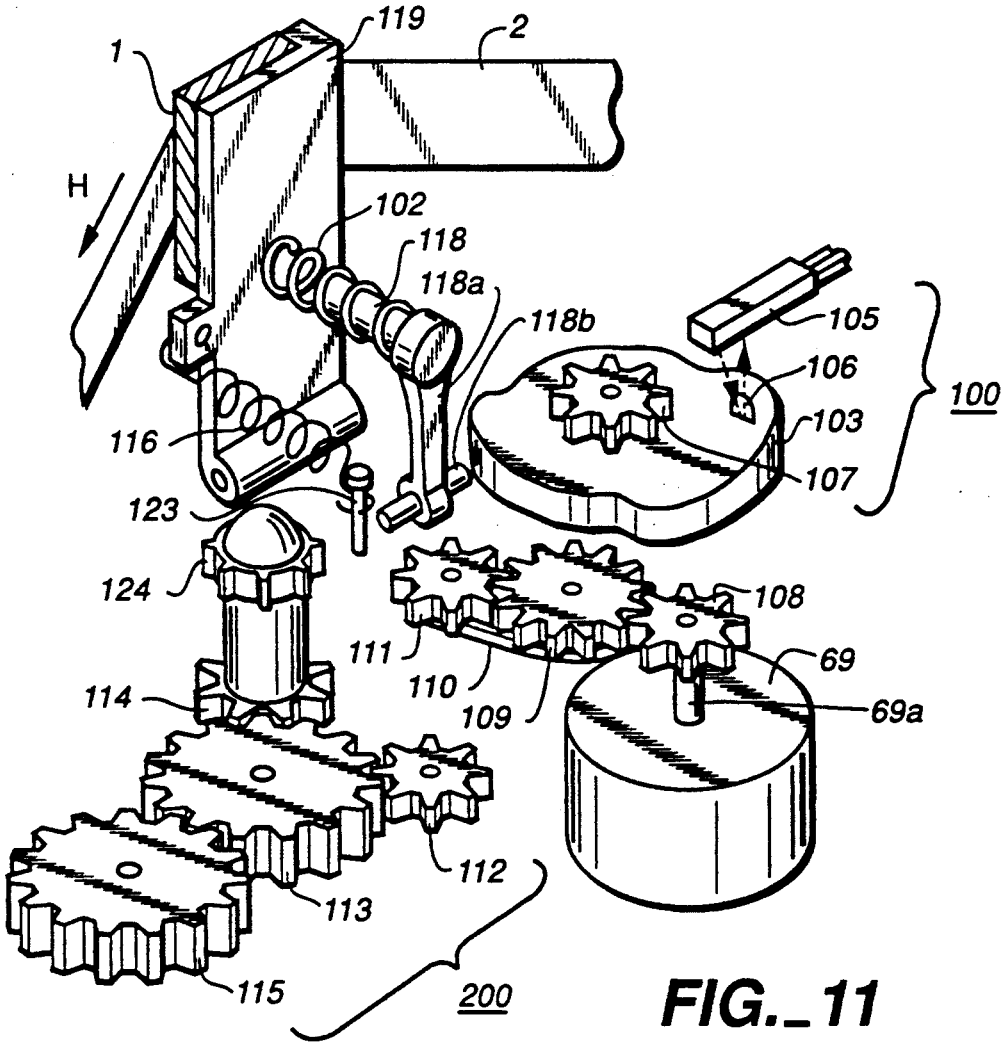
FIG. 11 is a perspective view of the gear assembly of FIG. 10A.

FIGS. 10A, 10B, and 11 show details of the gearing and cams in the interior of carriage 4. A heat radiation plate 119 supports thermal head 1 and are freely rotatable about shaft 121 which is attached to carriage frame 120. Ribbon winding motor 69 mounts to the lower part of carriage frame 120. Motor shaft 69*a* passes through carriage frame 120 and ends with drive gear 108. Planetary drive gear 109 engages drive gear 108 and satellite drive gear 111, which are mounted on support arm 110. Support arm 110 can move about on pin 110*a* which is attached the carriage frame 120. Gears 112 and 113 transmit power to drive gear 114 from satellite gear 111. Gear 114 and 124 engage a matching socket in the ink ribbon cartridge and are able to wind the ink ribbon. Drive gear 115 is partially exposed through carriage 4, as previously indicated, to transmit mechanical power outside carriage 4. When motor 69 moves in direction "M1", planetary drive gear 119 rotates in direction "N1", causing arm 110 to swing satellite drive gear 111 to engage gear 112. Drive gear 113 therefore rotates in the direction "P", and core 124 winds ink ribbon 2 past thermal head 1. But if stepper motor 69 turns the opposite direction (direction "M2"), as in FIG. 10B, arm 110 swings gear 111 to engage gear 107 on cam 103. Since cam follower 118 rides on cam 103, the oblong shape of cam 103 will put pressure on head 1 through plate 119 and spring 102. Three lobes on cam 103, having radiuses "$r_1$", "$r_2$", and "$r_3$", provide for two different pressures and one release position. Radius $r_1$ is the smallest and corresponds to lobe 103*a*. Radius $r_3$ is the largest and corresponds to lobe 103*c*. Intermediate radius $r_2$ corresponds to lobe 103*b*. A reflector 106 is positioned on the top of cam 103 so the cam angle can be sensed by photosensor 105. In the present example, reflector 106 corresponds to when lobe 103*a* contacts cam follower 118. Rocker 118*a* has a spring support 118, rotates about shaft 118*b* which is attached to the carriage frame 120. Coil spring 102 exerts a force in direction "K1" depending on the position of cam 103. When cam 103 is in contact with follower 118 at lobe 103*a*, thermal head 1 moves in direction "K2", tensile force through coil spring 116 separates print head 1 from platen 128, so that ink ribbon 2 and printing paper (not illustrated) can be removed or inserted between the platen 128 and the thermal head 1. When lobe 103*c* is engaged, the compression force of thermal head 1 is maximum, and when 103*b* is engaged, the compression force is reduced. Head compression/release mechanism 100 has cam 103, photosensor 105, spring support element 118 and compression coil spring 102 as its main elements. A motion direction switching mechanism comprises cam 103 and spring support element 118 as its principal elements. The angular position of cam 103 is detectable by photosensor 105. The head release position is selected when the carriage returns to a new line. Before the carriage begins printing, a lobe related to the desired compressive force is selected so that thermal head 1 may be pressed against platen 128. This position control is made possible by a control apparatus that manages the number of steps sent to the stepper motor, using the photosensor detection as a reference. It is well known that thermal transfer printing density and print quality are dependant on the compression force of the thermal head. A high compressive force is needed when printing ink on bond paper, because of the smoothness of the surface. Print quality on bond paper will also be improved when the printing speed is slowed down. In contrast, special thermal transfer paper needs only a small compressive force, and print quality will actually be quite good at high printing speeds. The use of cam 103 and the related mechanisms make it possible to tailor the compressive forces so that they are adapted to the particular type of recording paper or medium being used. This embodiment can also be used in a system similar to that of FIG. 4, but of course the tape transport motor 40 will not be necessary.

For label tape printing, carriage 4 is moved in direction "B" to where thermal head 1 lines-up just opposite to roller platen 31. Once carriage 4 has assumed its proper position, motor 69 is operated in one direction to move cam 103 which will select a compression force for print head 1. Then motor 69 reverses, the satellite gear 111 engages the ribbon winding mechanism (at gear 112), and the unit is ready to begin label tape production. Because carriage 4 has moved into position, drive gear 115 engages gear 131 coupling power to the mechanism that moves the two tapes in the label tape cassette 21 as well as platen roller 31. The surface velocity of platen roller 31, transparent tape 22, and ink ribbon 2 are matched so that they all move in unison under print head 1 during label tape printing. In this manner, only the data sent to the print head 1 will cause ink to be deposited. Otherwise, any rubbing action between these pieces could cause smudging and render the output tape usable.

The second exemplary embodiment has an advantage of being less complex, compared to the first, due to the fact that one motor has been eliminated. Label tape has a high surface smoothness, and good printing is possible even when lowering the compression force of the head during tape printing.

Current sensing heat type printing units may also be used for printing. The present invention is not limited to the thermal print heads described above. A head that uses electrodes and an ink ribbon having a resistance layer can give satisfactory results too.

Figure 12:
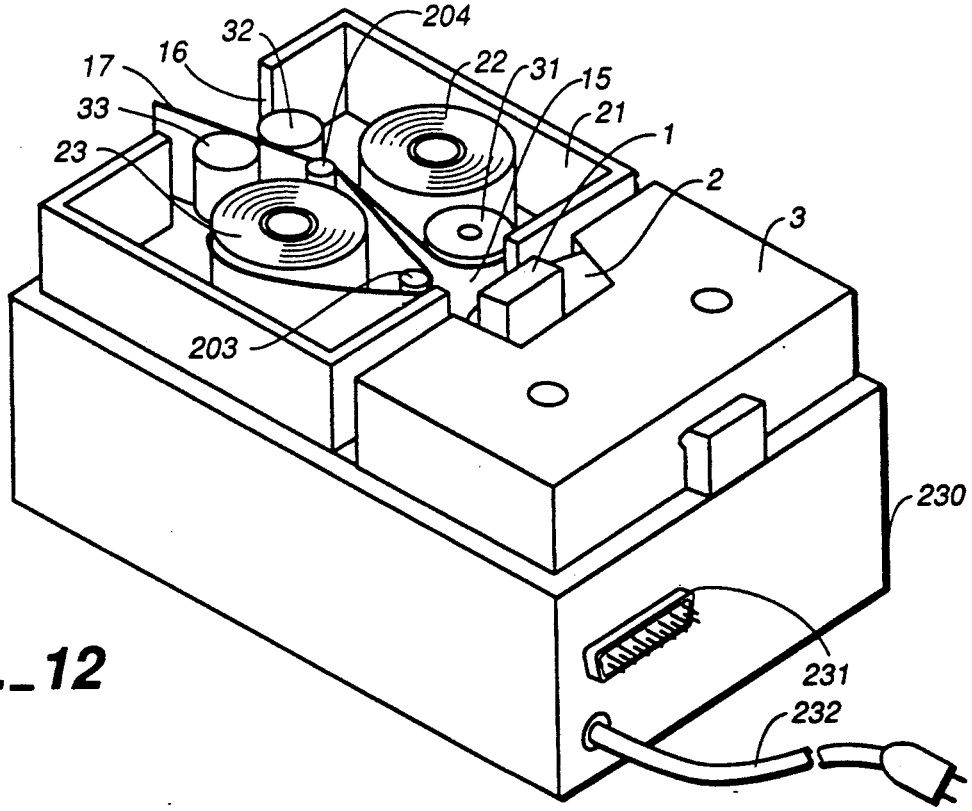
FIG. 12 is a perspective view of a another embodiment for label tape making only using the label tape cassette and ink ribbon cartridge of the above embodiments.
Figure 13:
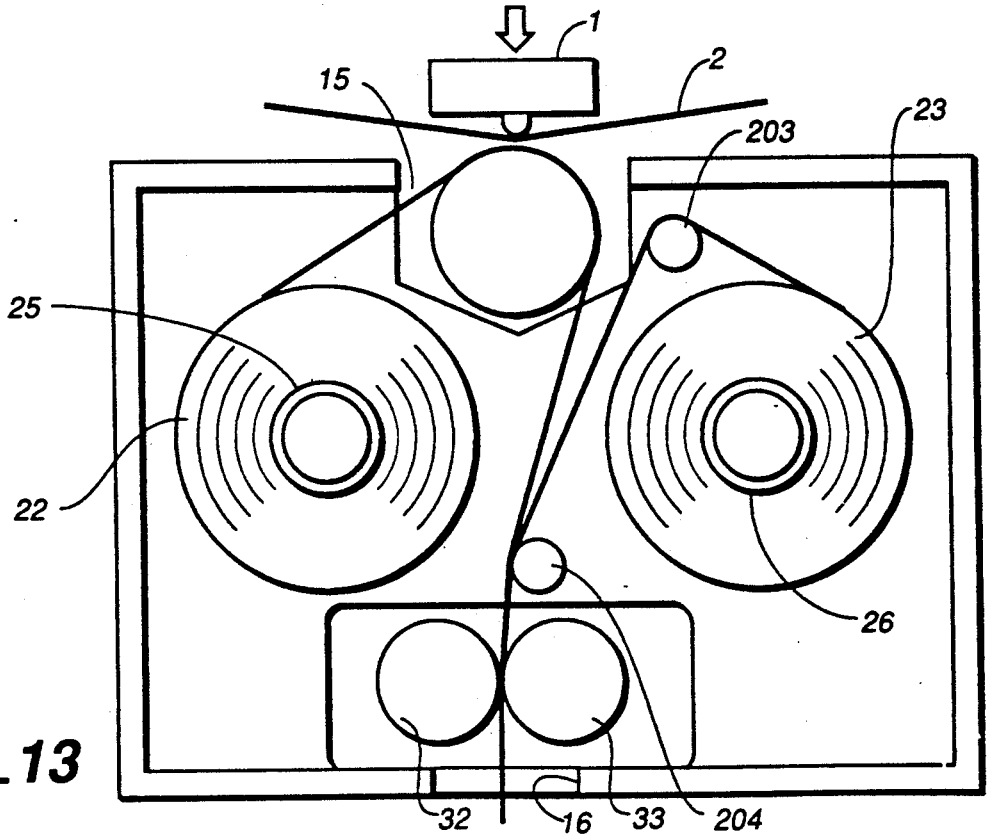
FIG. 13 is a cross-sectional view of an alternative label tape cassette used in conjunction with the embodiment of FIG. 12.

FIGS. 12 and 13 show a system that has eliminated the paper printing section, and simply has a label tape cassette, print head, and ink ribbon similar to those described above. The system has thermal printing head 1, a ribbon cassette 3 containing thermal transfer ink ribbon 2, a label tape cassette 21 shown with the cover removed, a tape printing medium 22 wound around winding core 25, an adhesive tape 23, and a winding core 26 for adhesive tape 23. Guide rollers 203 and 204 inside label tape cassette 21 are used to guide tape movement. Printing roller platen 31, compression roller 32, and opposing roller 33 are all exterior of cassette 21 when cassette 21 is installed in the system. Printing window 15 and tape exit 16 allow a short path for the discharge of lettering tape 17 after printing and tape joining. Printing window 15 and tape exit 16 are, therefore, disposed at opposite sides of the cassette. This makes it possible to minimize the tape transport length, and makes it possible to achieve an optimum layout of parts within the cassette to obtain the greatest efficiency. The system has a main chassis 230 for housing a vertically oriented tape platen roller drive mechanism, a compression roller drive mechanism, a winding mechanism for ink ribbon 2, control circuits that drive these mechanisms, and thermal head 1. A power line 232 and an electrical signal interface 231 are also provided. When label tape cassette 21 is mounted to chassis 230, thermal head 1 presses against the roller platen, pinching ink ribbon 2. Characters and symbols can then be printed on transparent tape 22. These characters and symbols are reversed to be mirror-image, as mentioned above. After printing, the tape moves to compression roller pair (32 and 33) and is adhesively joined to adhesive tape 23 to produce lettering tape 17. The printed ink is on an inside surface, and is therefore protected. The tape 17 very durable, and is almost impervious to rubbing, thus giving it a very wide range of applications. Because the printing indicia is internal between the two tapes, even ink jet printing mechanisms can be used.

The above embodiments have described the employment of stepper motors. It is possible to use DC motors instead, and to use more position detection photosensors to gauge the positions of various mechanisms. In some situations, the use of these alternatives may be more appropriate.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

What is claimed is:

1. A system for printing, comprising:

means to print indicia selectively on a first or a second printing media respectively comprising a linear strip form and a sheet form, said print means including a single carriage having a print head and inking means, transport means to move said carriage along a path of travel between a first zone for printing on said first printing media and a second zone for printing on said second printing media, said print means having a first printing mode for holding said carriage in a stationary position for printing on said first printing media at said first zone as said first printing media is moved relative to said print head and a second printing mode for providing reciprocal motion to said carriage for printing on said second printing media at said second zone as said print head is moved relative to said second printing media;

means in said path of travel to determine if said carriage is in said first print zone or is in said second print zone, control means responsive to said carriage determining means to transport said carriage to either said first print zone or said second print zone depending upon whether said first or second printing mode has been selected.

2. The printing system of claim 1 further comprising detection means to ascertain movement of said carriage from one of said zones to the other said zones.

3. The printing system of claim 1 wherein said print head is a thermal print head having a plurality of heating elements to be selectively heated to transfer ink from an ink ribbon position between said print head and one of said printing media by means of melting ink directly onto said one printing media.

4. The printing system of claim 1 wherein said first printing media is a linear print tape, and a releasably attachable label tape cassette at said first zone for supporting said label tape.

5. The printing system of claim 4 wherein said label tape cassette comprises said print tape on a roll therein for passage past an aperture in said cartridge to receive printed ink characters thereon from said print head, an adhesive tape also supported on a roll in said label tape cassette, and a means in said label tape cassette to join said print tape to said adhesive tape after printing on said print tape in a manner that said printed ink characters are sealed between said print and adhesive tapes.

6. A system for printing indicia on at least two different types of print media and having a carriage with a multi-element printing head, said media placed in juxtaposed position in a plane in front of said carriage print head with said carriage adapted for transverse movement in a path parallel to each said media plane so that said print head is accessible to either of said media, said system comprising:

a first print region wherein said print media comprises a print sheet;

a second print region wherein said print media comprises a first linear print tape, a tape cassette within which said tape is supported, a second print tape supported in said cassette and means in said cassette for assembling said first print tape to said second print tape after printing is accomplished on one of said tapes forming a finished composite tape;

carriage transport and positioning means for placing said carriage in either said first print region or said second print region;

selection means to provide for printing mode selection between either printing on said print tape media or on said print sheet media and correspondingly moving said carriage via said carriage transport means to said first region or to said second region and position said carriage for printing on said mode selected media; and carriage locating means connected to said selection means indicative of when said carriage crosses a boundary between said first print region and said second print region to permit said selection means to determine if said carriage is initially in said first print region or in said second region when initially receiving a printing mode selection is first received by said selection means.

7. The printing system of claim 6 including means to accelerate the movement of said carriage when said carriage transport and positioning means is activated to move said carriage from one print region to the other print region.

8. The printing system of claim 6 further comprising control means in said selection means responsive to said carriage locating means for parking said carriage at a predetermined position within said second print region.

9. A system for printing indicia on at least two different types of print media and having a carriage with a multi-element printing head, said media placed in juxtaposed position in a plane in front of said carriage print head with said carriage adapted for transverse movement in a path parallel to each said media plane so that said print head is accessible to either of said media, said system comprising:

a first print region wherein said print media comprises a print sheet;

a second print region wherein said print media comprises a first linear print tape, a tape cassette within which said tape is supported, a second print tape supported in said cassette and means in said cassette for assembling said first print tape to said second print tape after printing is accomplished on one of said tapes forming a finished composite tape;

carriage transport and positioning means for placing said carriage in either said first print region or said second print region;

a cartridge supported on said carriage;

an ink ribbon mounted in said cartridge for passage over said print head;

ink ribbon winding means on said carriage for moving said cartridge ink ribbon relative to said print head when said carriage is positioned in either of said print regions;

a tape drive gear assembly at said second print region for moving said print tape relative to said print head when said carriage is positioned in said second print region;

said ink ribbon winding means and said print tape being concurrently transported in synchronized relation with print data provided to said print head.

10. The printing system of claim 9 further comprising coupling means for engaging said ink ribbon winding means to said tape drive gear assembly to concurrently move said ink ribbon and said print tape when said carriage is in said second print region.

11. The printing system of claim 9 wherein said ink ribbon winding means comprises a stepper motor.

12. The printing system of claim 9 wherein said second print region comprises a platen roller, one of said print tapes held between said print head and said platen roller when said carriage is in said second print region, said ink ribbon winding means including power take-off means to cause engagement and disengagement of said print head against said platen roller, said power take-off means also including means to advance both of said print tapes as well as said ink ribbon.

13. The printing system of claim 9 wherein said carriage further includes head pressure adjusting means for varying the compression force of said print head against said print media.

14. A print system having a single carriage supporting a print head for selectively printing on a first print media in a first print zone or printing on a second print media in a second print zone wherein said print media are supported in juxtaposed position substantially along a plane parallel to a path of movement for travel of said carriage and comprising:

transport means to move said carriage said first print zone and said second print zone and to position said carriage in a predetermined printing position for printing while in said first printing zone and to position said carriage for lateral reciprocal movement within said second print zone, means in said path of travel to determine if said carriage is in said first print zone or is in said second print zone, control means responsive to said carriage determining means to activate said transport means to move said carriage into a selected print zone, a cassette in said first print zone supporting a roll of linear print tape, a first platen along said plane at said predetermined printing position in said first print zone to receive said print tape at a first printing region for printing thereon when said carriage is in said first print zone, a second platen along said plane in said second print zone along an elongated printing path to receive a print sheet at a second printing region for printing thereon when said carriage is in said second print zone, means mounted in said first print zone for feeding said print tape from said roll in said cassette through said first printing region for printing thereon by said print head, and means mounted in said second print zone for feeding said print sheet in a direction perpendicular to the reciprocal movement of said carriage through said second printing region for printing thereon by said print head during the lateral reciprocal movement of said carriage.

15. The print system of claim 14 further comprising selection means to provide print data to said print head such that said data is provided to print data either in a normal right-side-up mode or in an inverted/reverse order mode depending on whether said carriage is positioned at said first zone or at said second zone.

16. The print system of claim 14 further comprising a cartridge on supported on said carriage, an ink ribbon supported in said cartridge for passage over said print head, ink ribbon drive means in said cartridge and said carriage to move said ribbon over said print head, interengaging means in said print head carriage, comprising an extension of said ink ribbon drive means, for engaging said first print zone feeding means when said carriage means is positioned at said predetermined printing position whereby said first platen and said print tape are fed through said first printing region for printing thereon by said print head by means of said ink ribbon drive means.

17. The printing system of claim 1 further comprising selection means to provide print data to said print head such that said data is provided to print data either in a normal right-side-up mode or in an inverted/reverse order mode depending on whether said carriage is positioned at said first zone or at said second zone.

* * * * *